US007597058B2

(12) United States Patent
Ishikawa et al.

(10) Patent No.: US 7,597,058 B2
(45) Date of Patent: Oct. 6, 2009

(54) APPARATUS FOR ADJUSTING TIMING OF NEEDLE AND LOOPTAKER OF SEWING MACHINE

(75) Inventors: Hitoshi Ishikawa, Nishio (JP); Tatsunori Fukuda, Nagoya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 56 days.

(21) Appl. No.: 12/073,349

(22) Filed: Mar. 4, 2008

(65) Prior Publication Data

US 2008/0229990 A1 Sep. 25, 2008

(30) Foreign Application Priority Data

Mar. 22, 2007 (JP) ..... 2007-073936
Jan. 29, 2008 (JP) ..... 2008-017686

(51) Int. Cl.
*D05B 69/14* (2006.01)
*D05B 57/32* (2006.01)

(52) U.S. Cl. ..... 112/220; 112/190

(58) Field of Classification Search ..... 112/182, 112/185, 189–201, 220, 284; 474/7, 132–138
See application file for complete search history.

(56) References Cited

U.S. PATENT DOCUMENTS 865,149 A * 9/1907 Ammerman ..... 112/182
2,662,495 A 12/1953 Parry
2,945,393 A * 7/1960 Paulson ..... 477/7
4,758,208 A * 7/1988 Bartos et al. ..... 474/135
4,771,715 A 9/1988 Inagaki
4,924,788 A 5/1990 Brown
4,934,989 A * 6/1990 Furukawa et al. ..... 474/135
5,067,423 A * 11/1991 Thompson ..... 112/220
5,189,971 A * 3/1993 Frankel et al. ..... 112/220
5,870,960 A * 2/1999 Brown ..... 112/220
6,904,853 B2 * 6/2005 Chen ..... 112/248

FOREIGN PATENT DOCUMENTS

GB 8706 4/1914
GB 534345 3/1941
GB 2 073 794 A 10/1981
JP 49-110450 10/1974

OTHER PUBLICATIONS

Extended European Search Report issued in corresponding EP Patent Application No. 08005135.2, Jul. 25, 2008, EPO, Munich, DE.

* cited by examiner

*Primary Examiner*—Ismael Izaguirre
(74) *Attorney, Agent, or Firm*—Buchanan Ingersoll & Rooney PC

(57) ABSTRACT

An apparatus for adjusting a timing of a needle and a looptaker of a sewing machine provided at a zigzag sewing machine having an upper shaft for driving a needle bar, a lower shaft for driving a looptaker, a machine frame, and a timing belt for connecting and synchronizing the shafts includes a cam member including a first cam surface and a second cam surface, a first arm member and a second arm member supported by the machine frame and a first pulley and a second pulley mounted to the first arm member and the second arm member respectively and always contacting the timing belt, the first pulley following the first cam surface and the second pulley following the second cam surface.

20 Claims, 12 Drawing Sheets

APPARATUS FOR ADJUSTING TIMING OF NEEDLE AND LOOPTAKER OF SEWING MACHINE

CROSS REFERENCE TO RELATED APPLICATIONS

This application is based on and claims priority under 35 U.S.C. § 119 to Japanese Patent Application 2007-073936, filed on Mar. 22, 2007 and Japanese Patent Application 2008-017686, filed on Jan. 29, 2008, the entire content of which is incorporated herein by reference.

FIELD OF THE INVENTION

This invention generally relates to an apparatus for adjusting a timing of a needle and a looptaker of a sewing machine, which adjusts a timing when a hook of the looptaker encounters the needle in the sewing machine.

BACKGROUND

A conventional sewing machine disclosed in JP49-110450A includes an upper shaft driving a needle bar and a lower shaft driving a looptaker. The upper shaft is connected to a device for controlling a zigzag width for shifting the needle bar arm laterally. An apparatus for adjusting a timing of a needle and a looptaker is provided between the lower shaft and the looptaker (a looptaker shaft). The lower shaft and the looptaker shaft are connected by means of a pulley and a belt so that a rotation of the lower shaft is transmitted to the looptaker shaft via the belt. The belt contacts four idlers, i.e., two idler units. The sewing machine disclosed in JP49-110450A includes two idler units. The idler unit is connected to the device for controlling the zigzag width via a simple gear mechanism employing helical gears. A driving force is transmitted from the device for controlling the zigzag width to the idler units via the gear mechanism so that the two idler units operate at the same time in cooperation with the device for controlling the zigzag width. Belt tension changes as the idler units operate, thereby transmitting a non-uniform rotation to the looptaker shaft.

However, with the above-described sewing machine, the tension of the belt connecting the lower shaft and the looptaker shaft assumes inconstant because the two idler units operate at the same time by means of the simple gear mechanism employing the helical gears.

The inconstant belt tension, such as being high or low, may cause a torque difference between the upper shaft and the lower shaft and/or, noise and vibration.

In addition, unexpected changes occur to a rotation speed of the looptaker. Due to this, the changes of the rotation speed of the looptaker fails to follow a lateral shifting movement of the needle bar arm (i.e., the needle bar and a needle), thus causing a lag in the timing of the needle and the looptaker, that is, the timing when a hook of the looptaker encounters the needle. This timing lag may cause skipped stitches.

Furthermore, a loosen belt causes "tooth jumping" which may lead to a lag of a preset reference timing between the lower shaft and the looptaker shaft. This lag also may cause skipped stitches.

As described above, when the belt tension is inconstant relative to the rotation speed of the looptaker, a stable operation of a sewing machine may not be assured.

A need thus exists for an apparatus for adjusting a timing of a needle and a looptaker of a sewing machine, which is not susceptible to the drawback mentioned above.

SUMMARY OF THE INVENTION

According to an aspect of the present invention, an apparatus for adjusting a timing of a needle and a looptaker of a sewing machine provided at a zigzag sewing machine having an upper shaft for driving a needle bar holding a needle, a lower shaft for driving a looptaker, a machine frame for rotatably supporting the upper shaft and the lower shaft, and a timing belt for connecting and synchronizing the upper shaft and the lower shaft includes a cam member including a first cam surface and a second cam surface and rotated by a driving force, a first arm member and a second arm member each rotatably supported by the machine frame and a first pulley and a second pulley mounted to the first arm member and the second arm member respectively and always contacting the timing belt, the first pulley following the first cam surface and the second pulley following the second cam surface.

According to another aspect of the present invention, a zigzag sewing machine includes an upper shaft for driving a needle bar holding a needle, a lower shaft for driving a looptaker, a machine frame for rotatably supporting the upper shaft and the lower shaft, a timing belt for connecting and synchronizing the upper shaft and the lower shaft and an apparatus for adjusting a timing of the needle and the looptaker of the sewing machine, the apparatus including a cam member including a first cam surface and a second cam surface and rotated by a driving force, a first arm member and a second arm member each rotatably supported by the machine frame, and a first pulley and a second pulley mounted to the first arm member and the second arm member respectively and always contacting the timing belt, the first pulley following the first cam surface and the second cam surface following the second cam surface.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
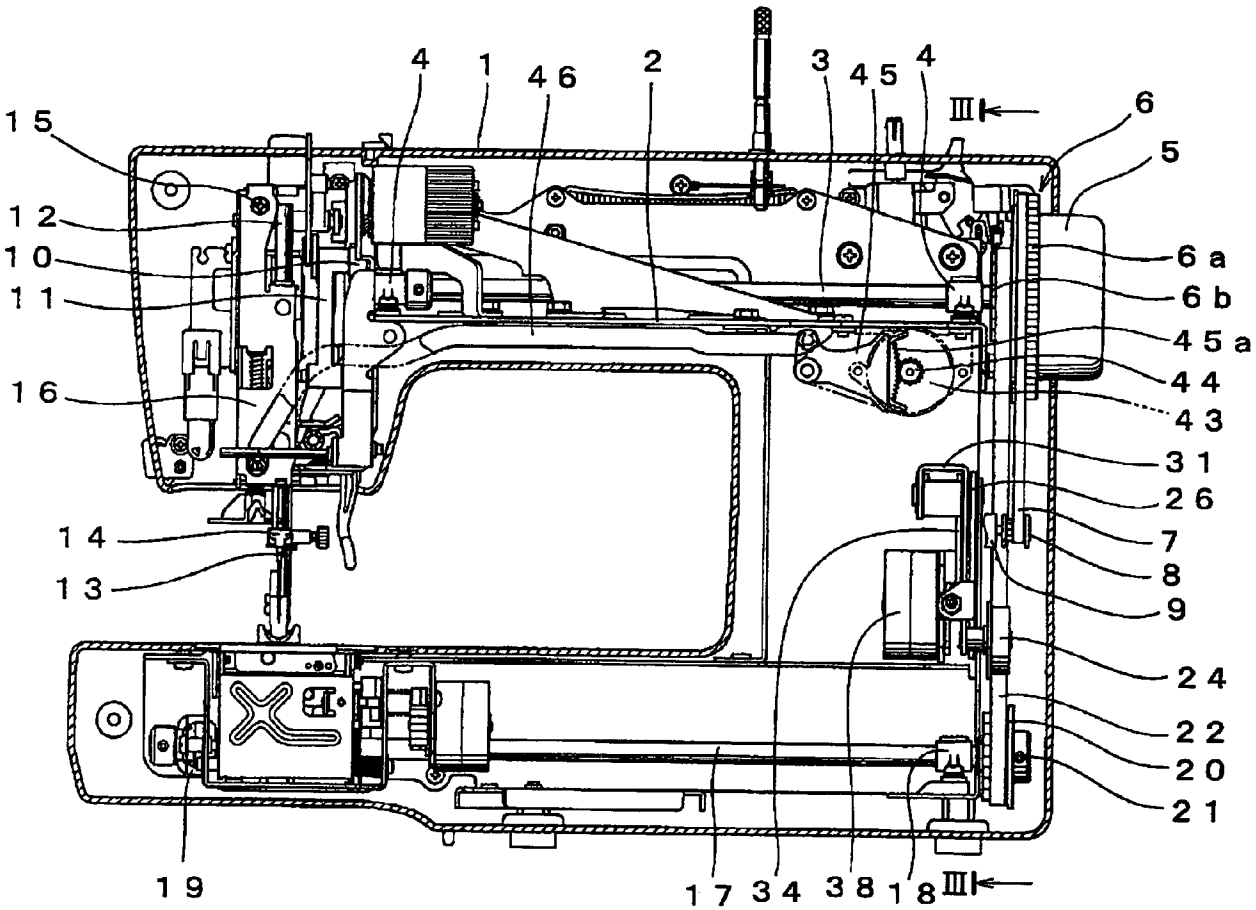
FIG. 1 is a front view of a sewing machine according to a first embodiment of the present invention.
Figure 2:
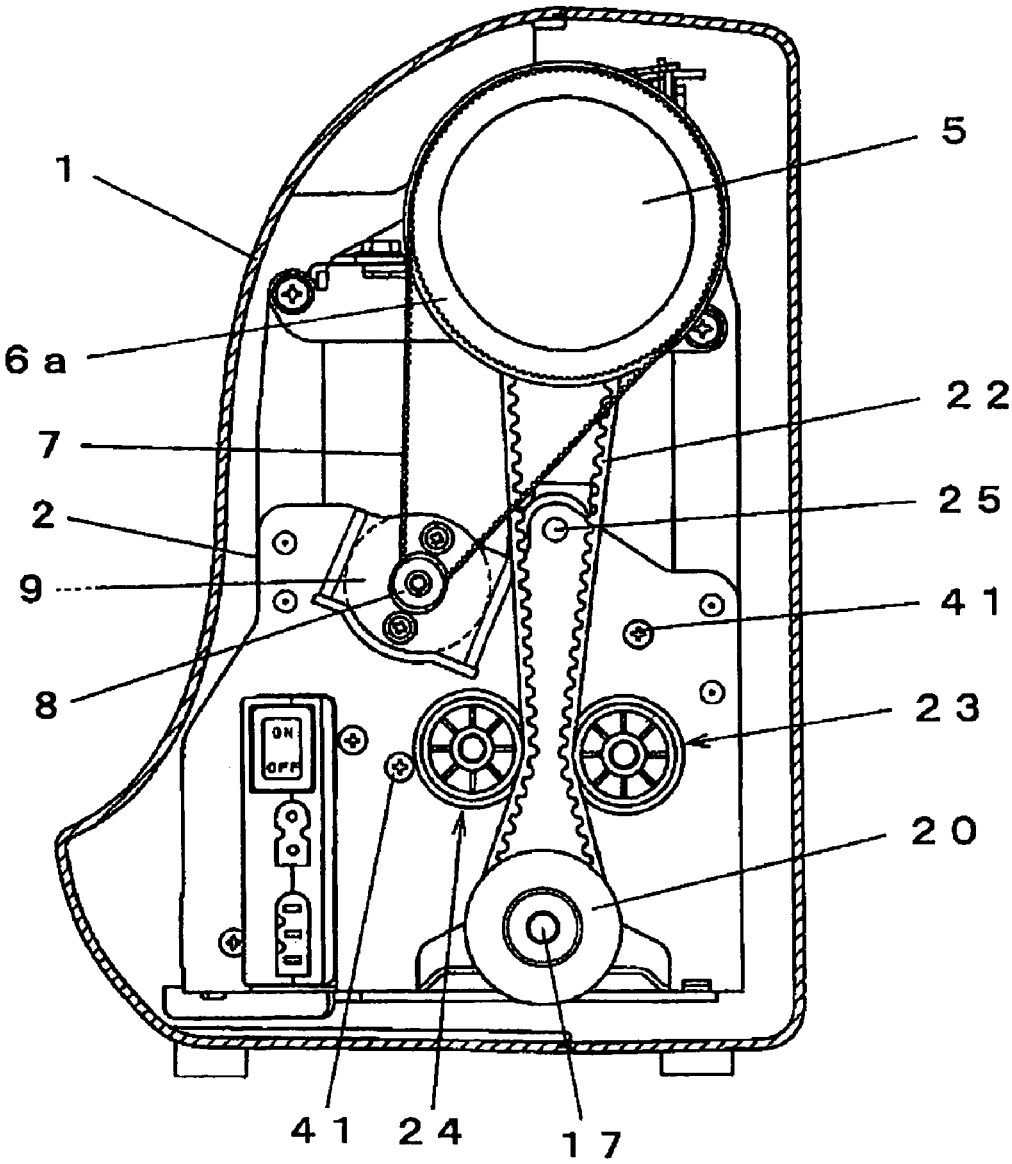
FIG. 2 is a side view of the sewing machine according to the first embodiment of the present invention.

A first embodiment of the present invention will be described below with reference to the attached drawings. As shown in FIG. 1 and FIG. 2, a sewing machine according to this embodiment includes a casing 1 and a machine frame 2. An upper shaft 3 is rotatably supported by a pair of bearings 4, 4 fixed to the machine frame 2. A hand wheel 5 and a pulley 6 are fixedly mounted to one end of the upper shaft 3. The pulley 6 includes a driven pulley 6*a* having a larger diameter and a timing pulley 6*b* (i.e., a first timing pulley) having a smaller diameter. A drive motor 9 is mounted to the machine frame 2 and a motor pulley 8 is fixedly mounted to an output shaft of the drive motor 9 for rotation. A drive belt 7 being endless and of a closed loop shape is fitted to the motor pulley 8 and the driven pulley 6*a* so that a rotation of a shaft of the drive motor 9 is reduced and transmitted to the upper shaft 3. As is conventional, a needle bar crank 10 is fixed to the other end of the upper shaft 3 so that a needle bar 12 is reciprocated vertically by means of a crank rod 11. A needle 13, i.e., a sewing needle for forming a thread loop, is fixedly mounted to a lower end of the needle bar 12 by means of a needle clamp 14. As is also conventional, the needle bar 12 is supported by a needle bar arm 16 so as to slide in a vertical direction, the needle bar arm 16 being supported by a shaft 15 so as to be shifted laterally. Consequently, the needle bar 12 is reciprocated vertically and, at the same time, shifted laterally with respect to the shaft 15. The lower shaft 17 is rotatably supported by bearings 18 and 19 each fixed to the machine frame 2. A timing pulley 20 (i.e., a second timing pulley) is fixedly mounted to one end of the lower shaft 17 for rotation by means of a set screw 21. The second timing pulley 20 and the first timing pulley 6*b* are set to have the same number of teeth. A helical gear is fixedly mounted to the other end of the lower shaft 17. Therefore, as the lower shaft 17 is rotated, a looptaker 50 (refer to FIG. 5 to FIG. 7) is rotated about a fixed axis at twice the speed of rotation of the lower shaft 17. A timing belt 22 being endless and of a closed loop shape is fitted to the first timing pulley 6*b* and on the second timing pulley 20 so that the upper shaft 3 and the lower shaft 17 rotate at a same speed under a normal operation. A tension pulley 23 and a tension pulley 24 (i.e., serving as a first pulley and a second pulley) are disposed between the first timing pulley 6*b* and the second timing pulley 20, closer to the second timing pulley 20, so that the tension pulley 23 and the tension pulley 24 sandwich the timing belt 22 from outsides thereof.

On the machine frame 2, a shaft 25 is disposed to protrude substantially between the timing pulley 6*a* and the second timing pulley 20, near the timing belt 22. A tension pulley bracket 26 (i.e., serving as a first arm member) has a substantially triangular shape, and includes a bush 27 and a shaft 28 each protrudingly provided in an upper and a bottom corner thereof, respectively. The shaft 25 fits into the bush 27 and the terision pulley 23 rotatably fits around the shaft 28. The remaining corner of the tension pulley bracket 26 is bent at right angles and provided with an internal thread 26*a* into which a fully threaded stud 29 is screwed and then fastened by means of a nut 30. An upper portion of a tension pulley bracket 31 (i.e., serving as a second arm member) is bent to have an inverted U-shaped vertical cross section and provided with holes 31*a* and 31*a* which rotatably fit around an outer surface of the bush 27. A shaft 32 is provided to protrude in a lower portion of the tension pulley bracket 31. The tension pulley 24 rotatably fits around the shaft 32. In a substantial center of the tension pulley bracket 31, a pin 33 is provided to protrude in an opposite direction of the shaft 32. The tension pulley bracket 26 and the tension pulley bracket 31 are coaxially supported by the machine frame 2. Similarly to the tension pulley 31, an upper portion of a cam follower arm 34 is bent to have an inverted U-shaped lateral cross section and includes holes 34*b* and 34*b* which rotatably fit around the outer surface of the bush 27. Further, the cam follower arm 34 is placed so that the inverted U-shaped portion of the tension pulley bracket 31 sandwiches the U-shaped portion of the cam follower arm 34. A spacer 36 is provided for a smooth operation of the cam follower arm 34. A pin 35 and a projection portion 34*a* are provided in a lower portion of the cam follower arm 34. The tension pulley bracket 26, the tension pulley 31 and the cam follower arm 34 rotate about the shaft 25 provided to the machine frame 2, respectively. The tension pulley bracket 26, the tension pulley 31 and the cam follower arm 34 are locked in an axial direction by means of a retaining ring 37. A stepping motor 38 is mounted to a bracket 39 by means of screws 40 and 40. The bracket 39 is then mounted to the machine frame 2 by means of screws 41 and 41. A cam 42 (i.e., serving as a cam member) is a plate cam having two independent cam surfaces 42*a* and 42*b* (i.e., serving as a first cam surface and a second cam surface) both of which surfaces are substantially symmetrical with respect to a vertical axis relative to a rotation shaft 38*a* of the stepping motor 38 and the rotation shaft 38*a* is securely fits into the cam 42. The cam surface 42*a* contacts the pin 35 of the cam follower arm 34. The cam surface 42*b* contacts the pin 33 of the tension pulley bracket 31. Further, a tip of the fully threaded stud 29 screwed into the tension pulley bracket 26 contacts the projection portion 34*a* of the cam follower arm 34. Consequently, when the stepping motor 38 turns, the tension pulley 23 and the tension pulley 24 are moved left or right with respect to the shaft 25 when viewed from a front in FIG. 2. The stepping motor 38 operates under computer control based on information including a rotation of the upper shaft 3, amount of the lateral movement of the needle bar arm 16, a thread type and a fabric type.

In FIG. 1, a pinion 44 is mounted to a shaft of a stepping motor 43 for controlling the amount of the lateral movement of the needle bar arm 16, and engages with a fan shaped gear 45*a* of a drive arm 45. The drive arm 45 is connected to a rod 46 and the rod 46 is then connected to a lower portion of the needle bar arm 16. Consequently, a rotational movement of the stepping motor 43 is transmitted to the needle bar arm 16, thereby shifting the needle 13 laterally.

In this embodiment, the cam 42 is driven by the stepping motor 38, however, the cam 42 may also be mechanically driven. That is, the cam 42 may be actuated, via a link or a gear, by a cam which generates zigzag patterns. When the cam 42 is driven by the stepping motor 38, a rotation speed of the looptaker 50 is freely controlled regardless of a rotation speed of the upper shaft 2 or the lower shaft 17, which allows the rotation speed of the looptaker 50 to appropriately change according to fabric types.

Next, an operation of the embodiment is described.

The rotation of the shaft of the drive motor 9 is reduced to about one-ninth and transmitted to the upper shaft 3. The rotary motion is then converted into a reciprocating motion by the needle bar crank 10 fixedly attached to the upper shaft 3, by which the needle bar 12 is reciprocated vertically via the crank rod 11. As the needle bar 12 reciprocates, the needle 13 fixedly mounted to the lower end of the needle bar 12 by means of the needle clamp 14 also reciprocates vertically. On the other hand, the first timing pulley 6*b* fixedly mounted to the one end of the upper shaft 3 rotates the second timing pulley 20 at a speed ratio of 1:1 via the timing belt 22, and thereby the lower shaft 17 is also rotated together with the second timing pulley 20. The rotation of the lower shaft 17 is doubled by the helical gear mechanism, and thereby the looptaker 50 is rotated. The stepping motor 43 rotates under computer control in synchronization with the rotation of the upper shaft 3, and thus the needle 13 is shifted laterally via the rod 46.

Figure 5:
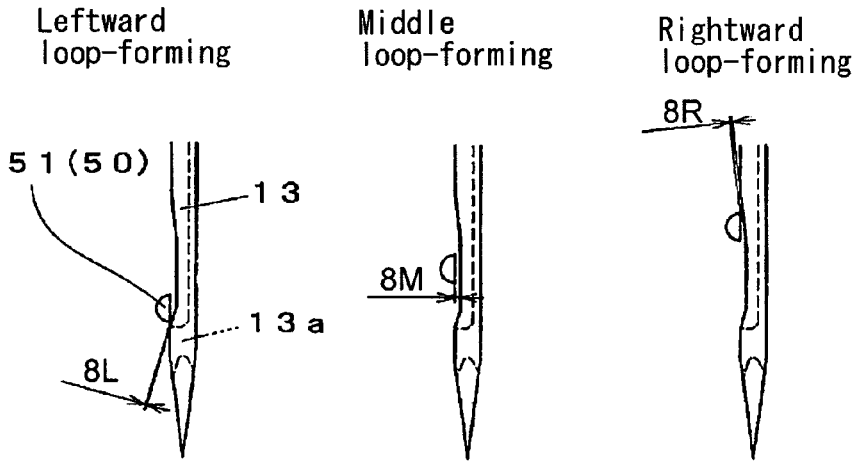
FIG. 5 Prior art
FIG. 5 is an enlarged view illustrating relative dispositions of a needle and a hook of a looptaker related to the prior art.
Figure 6:
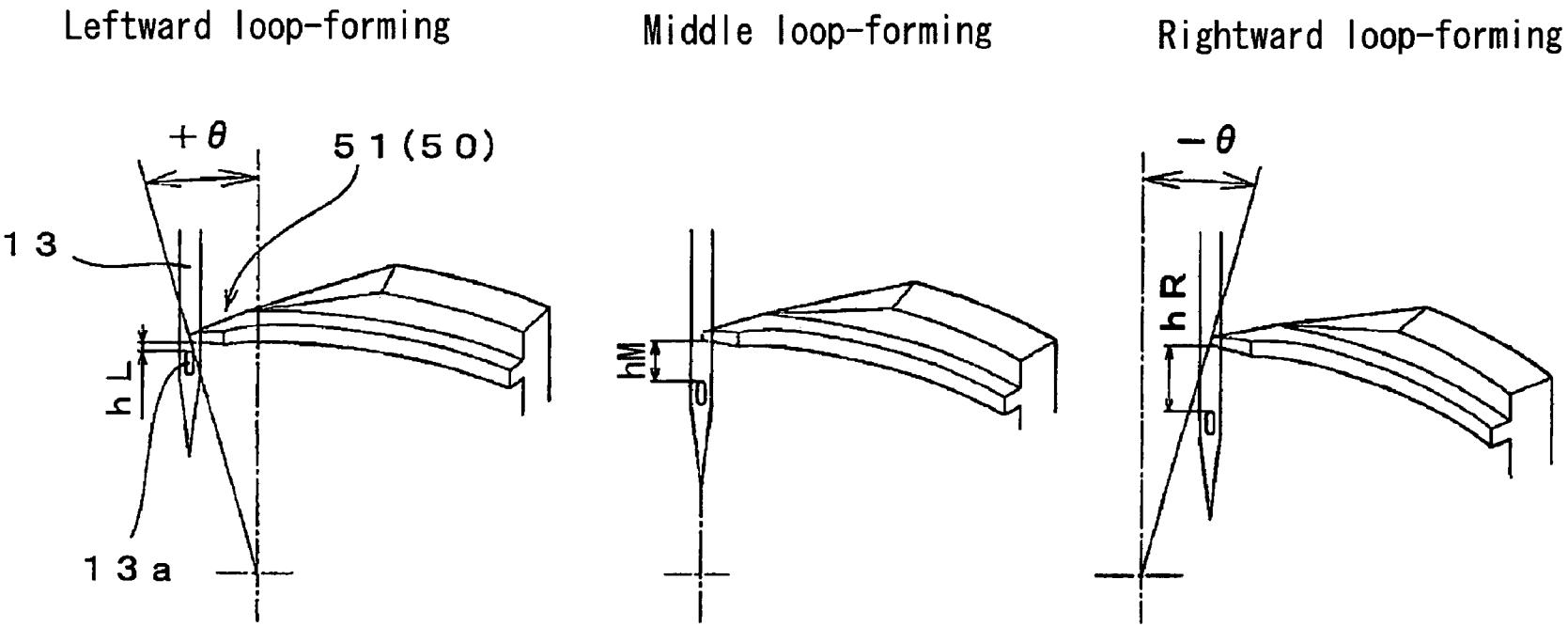
FIG. 6 Prior art
FIG. 6 is an enlarged view illustrating relative dispositions of the needle and the hook of the looptaker related to the prior art.

As shown in FIG. 5 and FIG. 6, with the conventional sewing machine, the timing of the needle 13 and a hook 51 of the looptaker 50 largely differs between a leftward loop-forming condition (i.e., a condition where the needle 13 forms a loop at a leftward position) and a rightward loop-forming condition (i.e., a condition where the needle forms a loop at a rightward position). More specifically, the hook 51 of the looptaker 50 is delayed by +θ in the leftward loop-forming condition and is advanced by −θ in the rightward loop-forming condition, each compared to a middle loop-forming condition (i.e., a condition where the needle 13 forms a loop in the middle), respectively. As shown in FIG. 5 and FIG. 6, a gap (δL, δM and δR) between the needle 13 and the hook 51 of the looptaker 50, and a distance (hL, hM and hR) between a needle hole 13*a* and the hook 51 of the looptaker 50 change according to the needle's loop-forming positions. The larger an amount of the lateral shifting of the needle 13 becomes, the more evident these changes are. These may cause defects including skipped stitches and an interference between the needle 13 and the looptaker 50.

Figure 8:
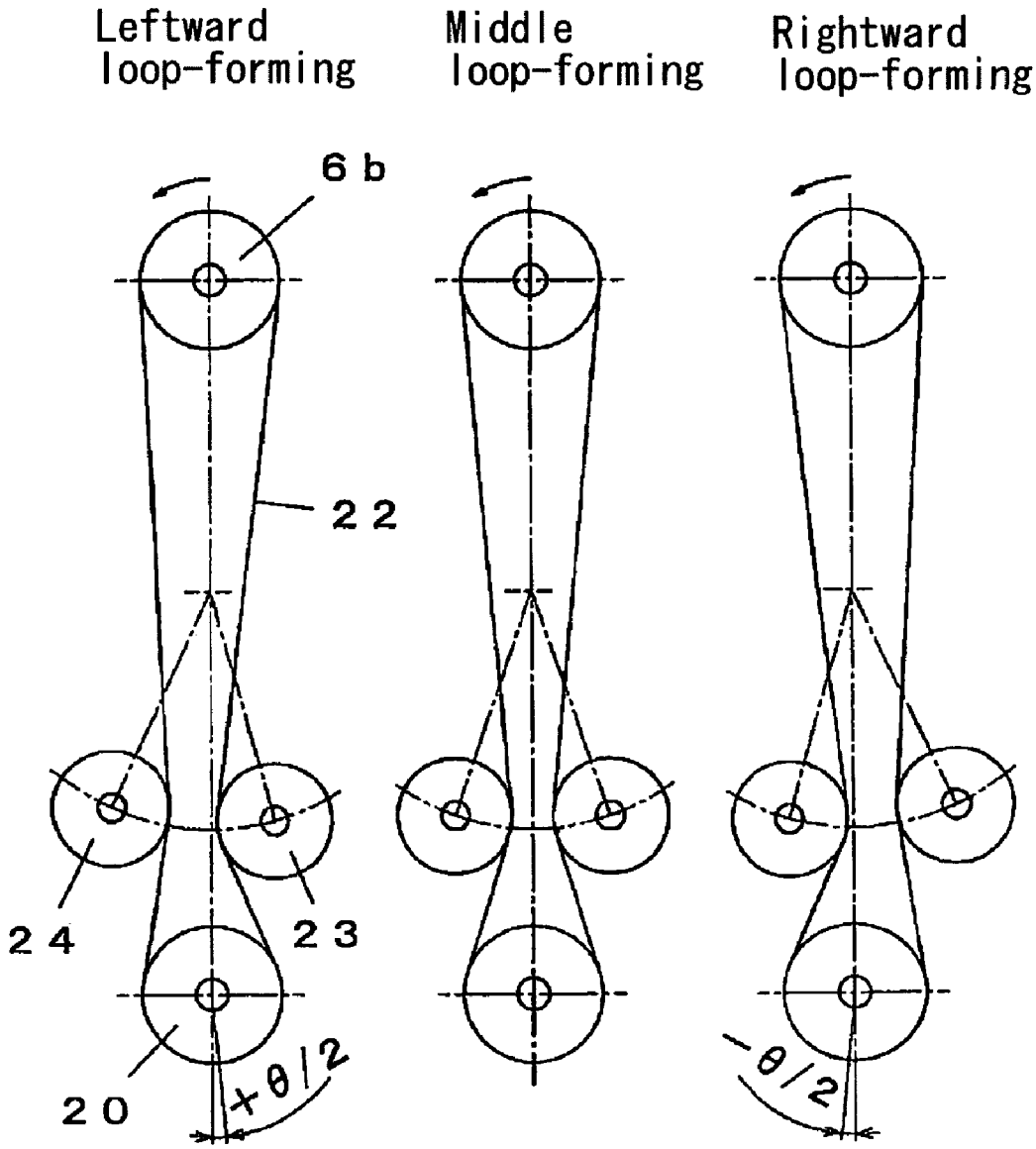
FIG. 8 schematically illustrates an operation of the embodiment of the present invention by showing movements of a timing belt and the pulleys.

By implementing a mechanism according to this embodiment, however, the defects are prevented. Specifically, when a computer issues a command of the leftward loop-forming, the rotation shaft 38*a* of the stepping motor 38 rotates clockwise, when viewed from a front in FIG. 3, for a predetermined amount. The rotation of the rotation shaft 38*a* rotates a shaft of the cam 42 clockwise for a predetermined amount, which causes the pin 35 to follow the cam surface 42*a* upward. At the same time, the pin 33 follows the cam surface 42*b* downwards. The cam follower arm 34 is then oscillated clockwise relative to the shaft 25. The movement of the cam follower arm 34 is transmitted to the tension pulley bracket 26 via the fully threaded stud 29 contacting the projection portion 34*a*, thereby moving the tension pulley 23 to the left. At the same time, the tension pulley bracket 31 is oscillated clockwise relative to the bush 27, thereby moving the tension pulley 24 to the left. Consequently, as shown in FIG. 8, in the leftward loop-forming condition, the second timing pulley 20 is advanced relative to the first timing pulley 6*b* by +θ/2 with respect to the middle loop-forming condition, thereby correcting +θ shown in the leftward loop-forming condition of FIG. 6 and thus allowing the same timing of the needle 13 and the looptaker 50 as in the middle loop-forming condition. Here, an amount of correction does not have to be precisely +θ/2 as long as neither skipped stitches nor interference between the needle 13 and the looptaker 50 occurs.

Figure 3:
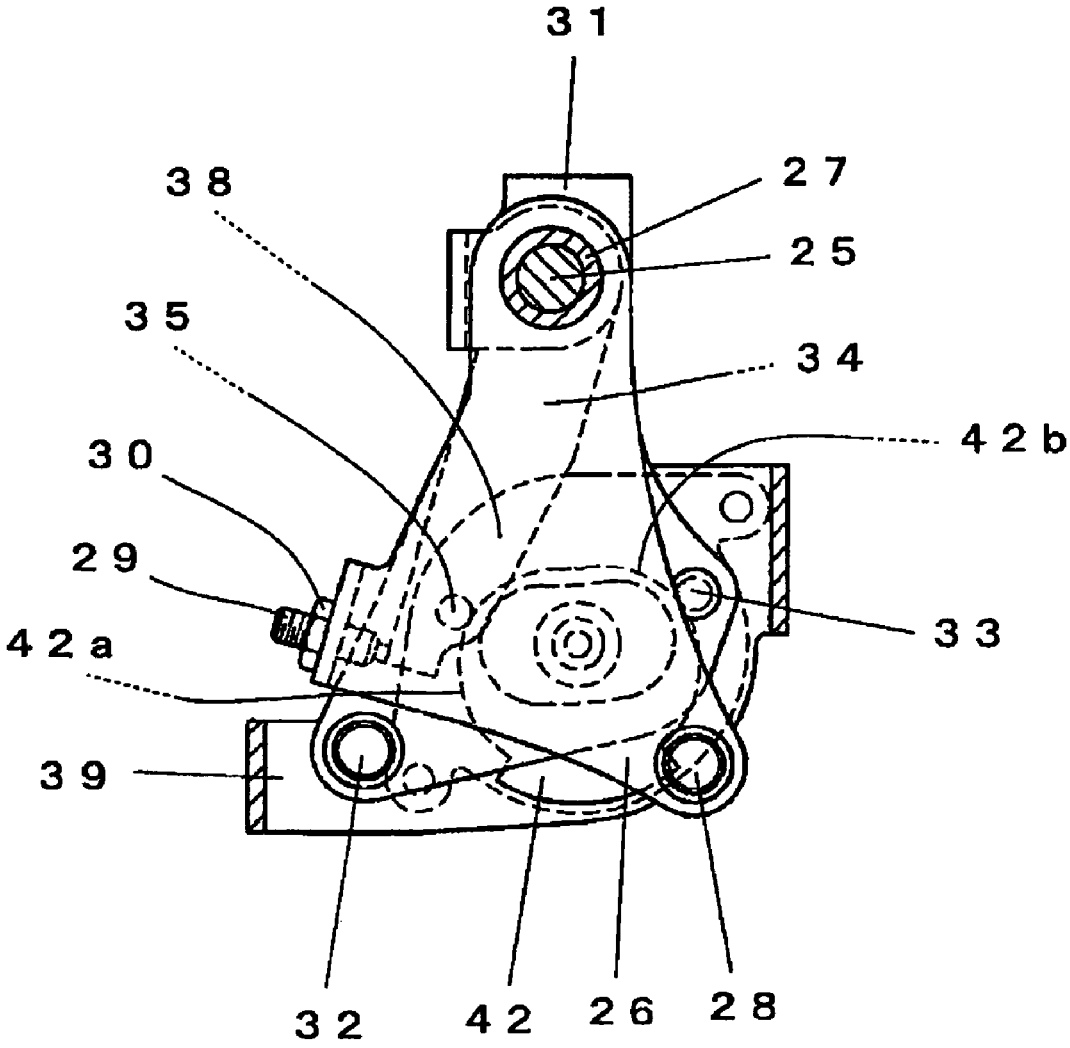
FIG. 3 is a cross-sectional view taken on line III-III of FIG. 1, which illustrates only principal parts related to tension pulleys.
Figure 4:
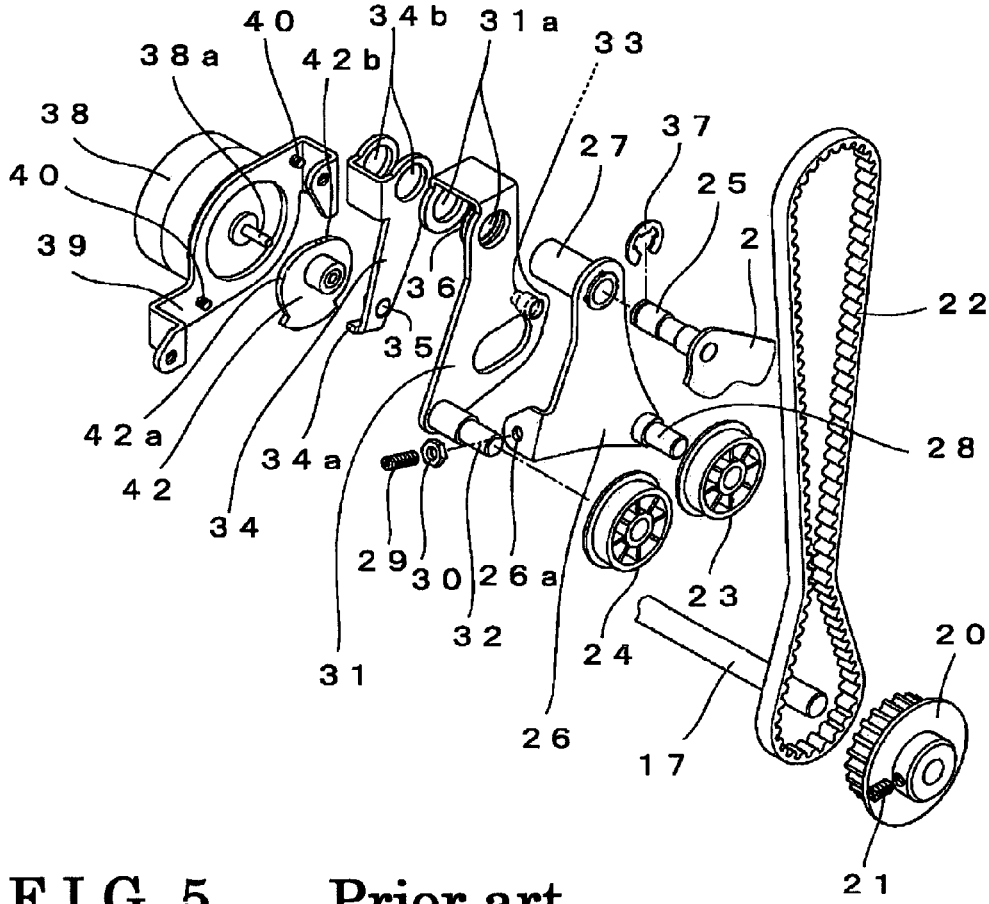
FIG. 4 is an exploded perspective view of the principal parts related to the pulleys.
Figure 7:
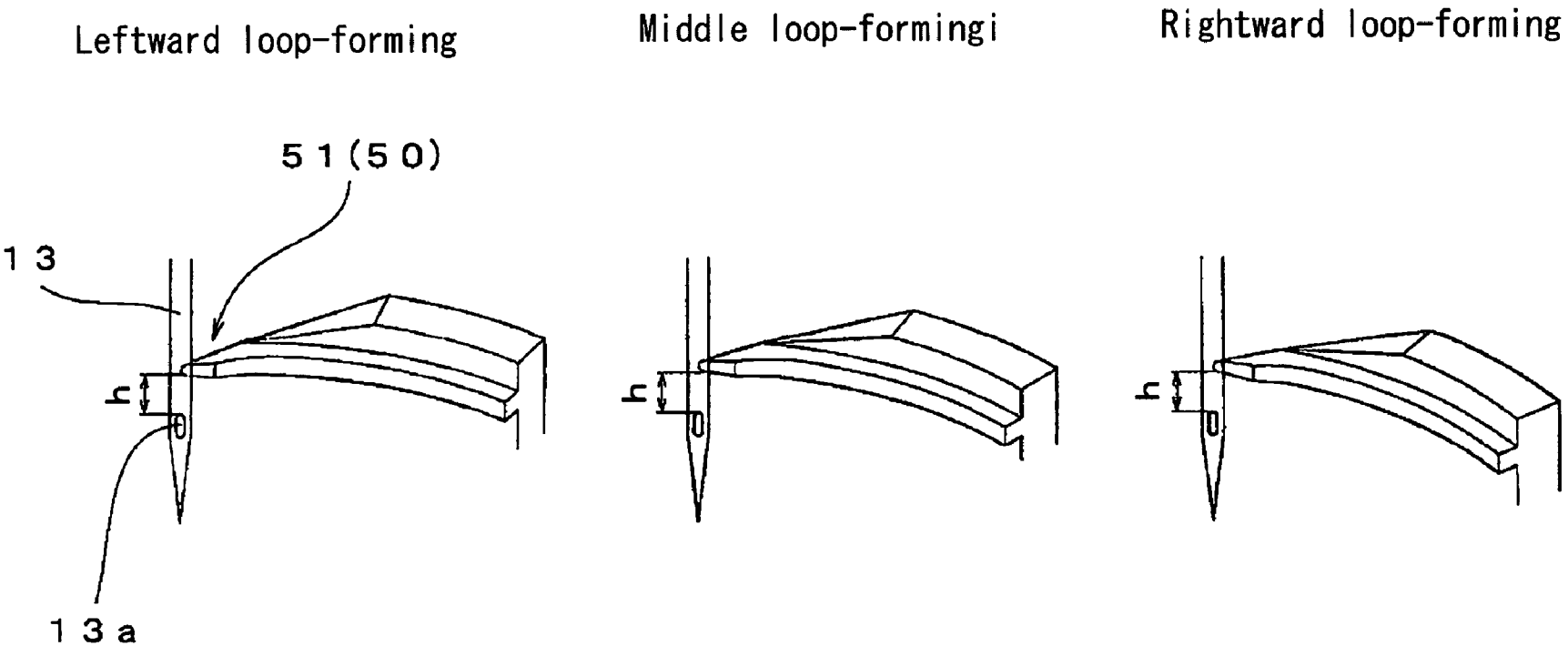
FIG. 7 is an enlarged view illustrating the relative dispositions of the needle and the hook of the looptaker according to the embodiment of the present invention.

Next, when the computer issues a command of the rightward loop-forming, the rotation shaft 38*a* of the stepping motor 38 rotates counterclockwise, when viewed from the front in FIG. 3, for a predetermined amount. Then, the tension pulley 23 and the tension pulley 24 are moved to the right with respect to the shaft 25 by an opposite logic of the above, thereby delaying the timing pulley by −θ/2. By this, as shown in FIG. 7, the needle 13 and the hook 51 of the looptaker 50 always encounter at the optimal timing regardless of the needle's loop-forming positions.

Variance of the tension of the timing belt 22 caused by dimensional tolerances between the upper shaft 3 and the lower shaft 17 and/or dimensional tolerances of an overall length of the timing belt 22 is adjusted by adjusting the fully threaded stud 29.

In addition, the two cam surfaces 42*a* and 42*b* of the cam 42 are set to have such cam profiles as to keep the tension of the timing belt 22 constant. In this case, as shown in FIG. 9, no proportionality is found between an amount of oscillation of the tension pulley bracket 26 relative to a rotation angle of the cam 42 and an amount of oscillation of the tension pulley bracket 31 relative to the rotation angle of the cam 42.

Figure 9:
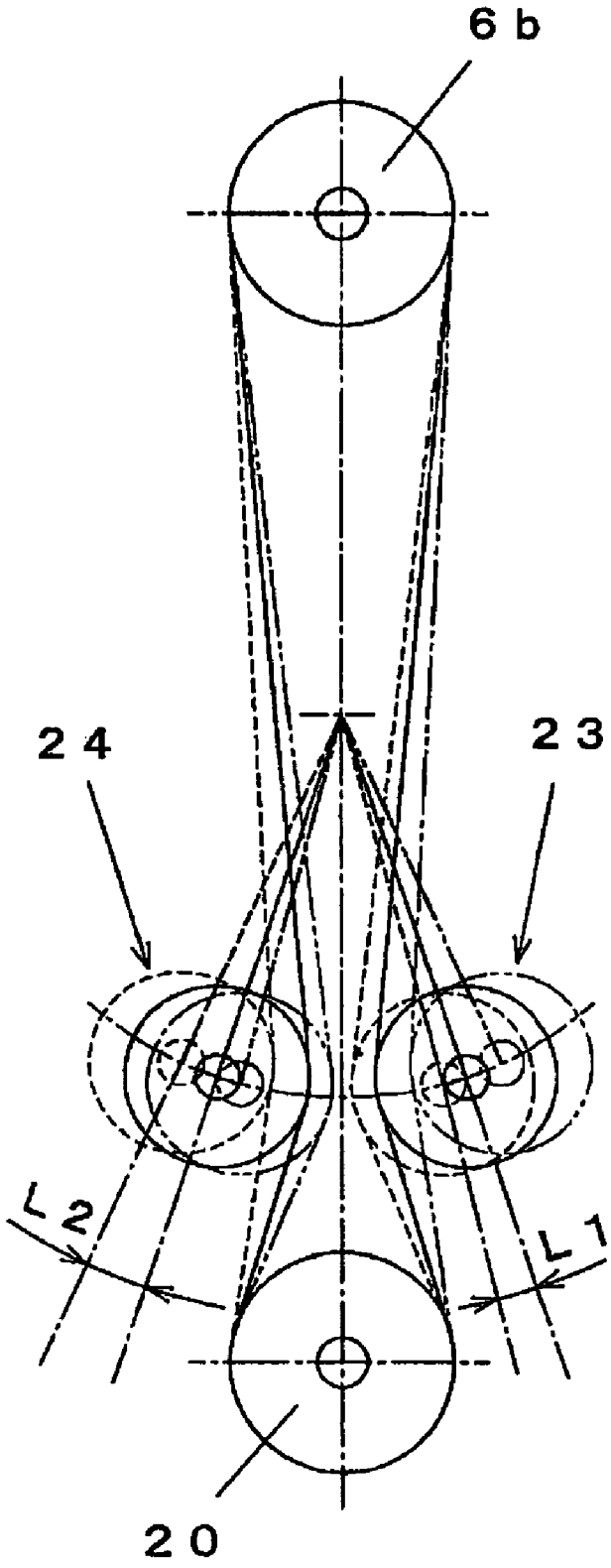
FIG. 9 is an overlaid view of the three cases shown in FIG. 8.

As shown in FIG. 9, when the needle's loop-forming point changes from the middle (drawn with full lines) to the left (drawn with dotted lines), a difference between a travel distance L1 of the tension pulley 23 and a travel distance L2 of the tension pulley 24 arises, more specifically, the travel distance L1 is shorter than the travel distance L2. The same applies to the needle's loop-forming point when it changes from the middle (drawn with full lines) to the right (drawn with double-dotted chain lines).

According to the mechanism in this embodiment of the present invention, the amount of following movement of the tension pulley bracket 26 (i.e., the travel distance L1 of the tension pulley 23) relative to the rotational angle of the cam 42 and the amount of following movement of the tension pulley bracket 31 (i.e., the travel distance L2 of the tension pulley 24) relative to the rotational angle of the cam 42 are independently controlled by the tension pulley bracket 26 and 31 respectively, thus allowing the tension of the timing belt 22 to be constant. By keeping the tension of the timing belt 22 constant, unexpected change in the rotation speed of the looptaker 50 is prevented. In addition, the needle 13 and the looptaker 50 always encounter at the optimized timing according to the needle's loop-forming positions, thereby preventing an occurrence of the skipped stitches. Further, torque acting on the upper shaft 3 and on the lower shaft 17 respectively is kept constant, thereby assuring a stable operation of a sewing machine without noise or vibration.

In brief, the above described first embodiment of the present invention provides an improvement of the zigzag sewing machine wherein the upper and lower shafts 3 and 17 are connected by the timing belt 22 for concurrent rotations, the looptaker 50 is rotated about the fixed axis in response to the rotation of the lower shaft 17, the needle 13 is moved vertically in response to the rotation of the upper shaft 3, and the needle 13 is shifted laterally between first and second stitch positions with respect to the looptaker 50. The improvement is for establishing the needle's equally optimal timed relationship with the looptaker 50 at each of the first and second stitch positions and comprises the cam 42 including the cam surface 42*a* and the cam surface 42*b* and rotated by the stepping motor 38, the tension pulley bracket 26 and the tension pulley bracket 31 each rotatably supported by the machine frame 2, and the tension pulley 23 and the tension pulley 24 mounted to the tension pulley bracket 26 and the tension pulley bracket 31 respectively and always contacting the timing belt 22, the tension pulley 23 following the cam surface 42*a* and the tension pulley 24 following the cam surface 42*b*.

Next, a second embodiment of the present invention will be described below with reference to the attached drawings. Identical functions and parts are designated by the same reference numerals as in the first embodiment. Functions and parts which differ from those of the first embodiment are explained in details.

Figure 10:
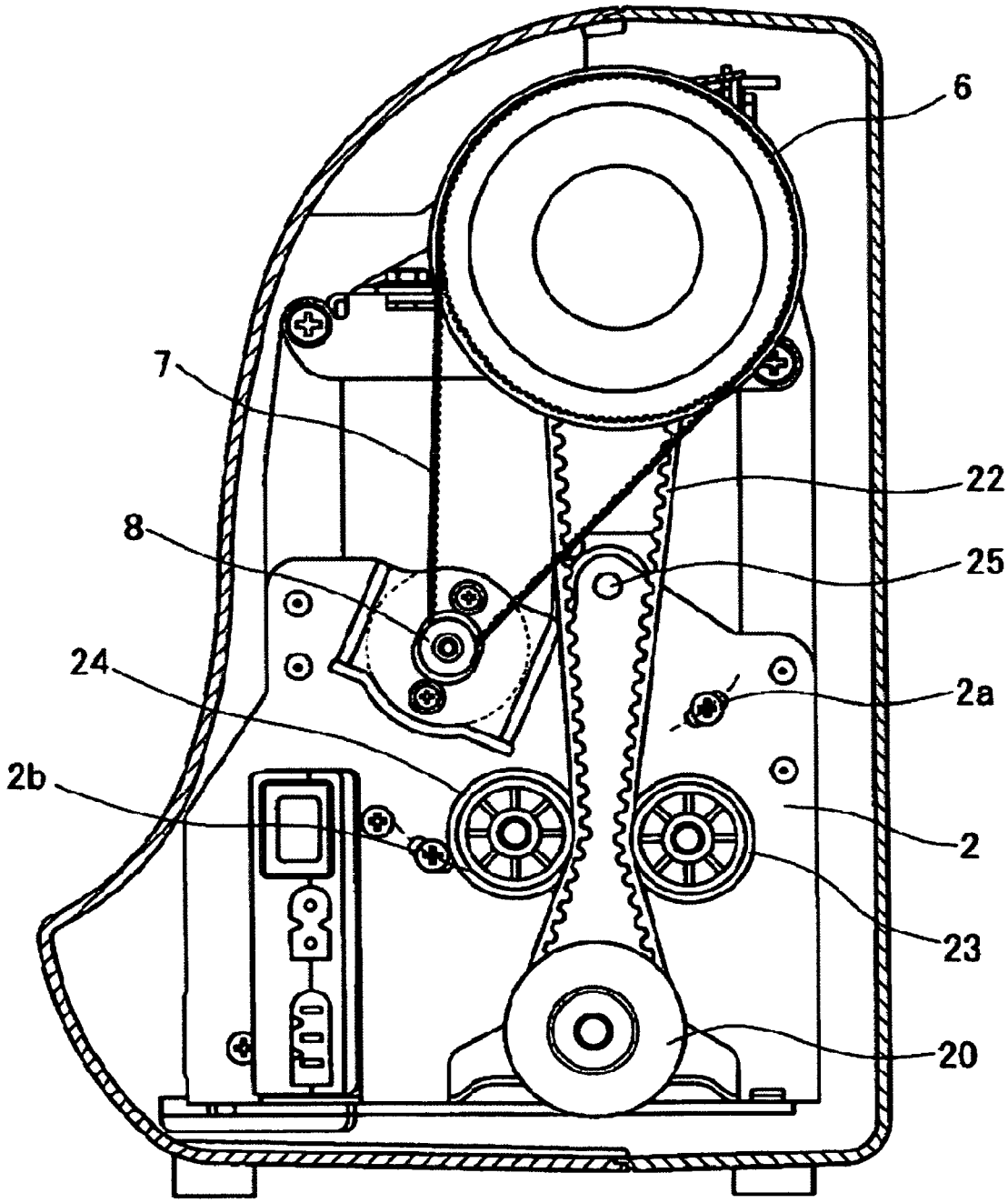
FIG. 10 is a side view of the sewing machine according to a second embodiment of the present invention, where a bracket is mounted to a machine frame so as to be rotatable about a shaft relative to the machine frame for adjustment upon assembly.

As shown in FIG. 10, screw holes 2*a* and 2*b* provided on the machine frame 2 for mounting the bracket 39 thereto are each substantially oval shaped and positioned in circumferences of concentric circles centered at the shaft 25. Therefore, a mounting angle of the tension pulley bracket 26, the tension pulley bracket 31, the cam follower arm 34, the cam 42 and the stepping motor 38, all of which are combined together with the bracket 39, is adjustable. By adjusting the fully threaded stud 29 screwed into the tension pulley bracket 26, relative positions of the cam follower arm 34 and the tension pulley bracket 26 are adjusted. Then, the tension pulley 23 moves relative to the tension pulley 24, and thus the tension of the timing belt 22 is adjusted.

Figure 11:
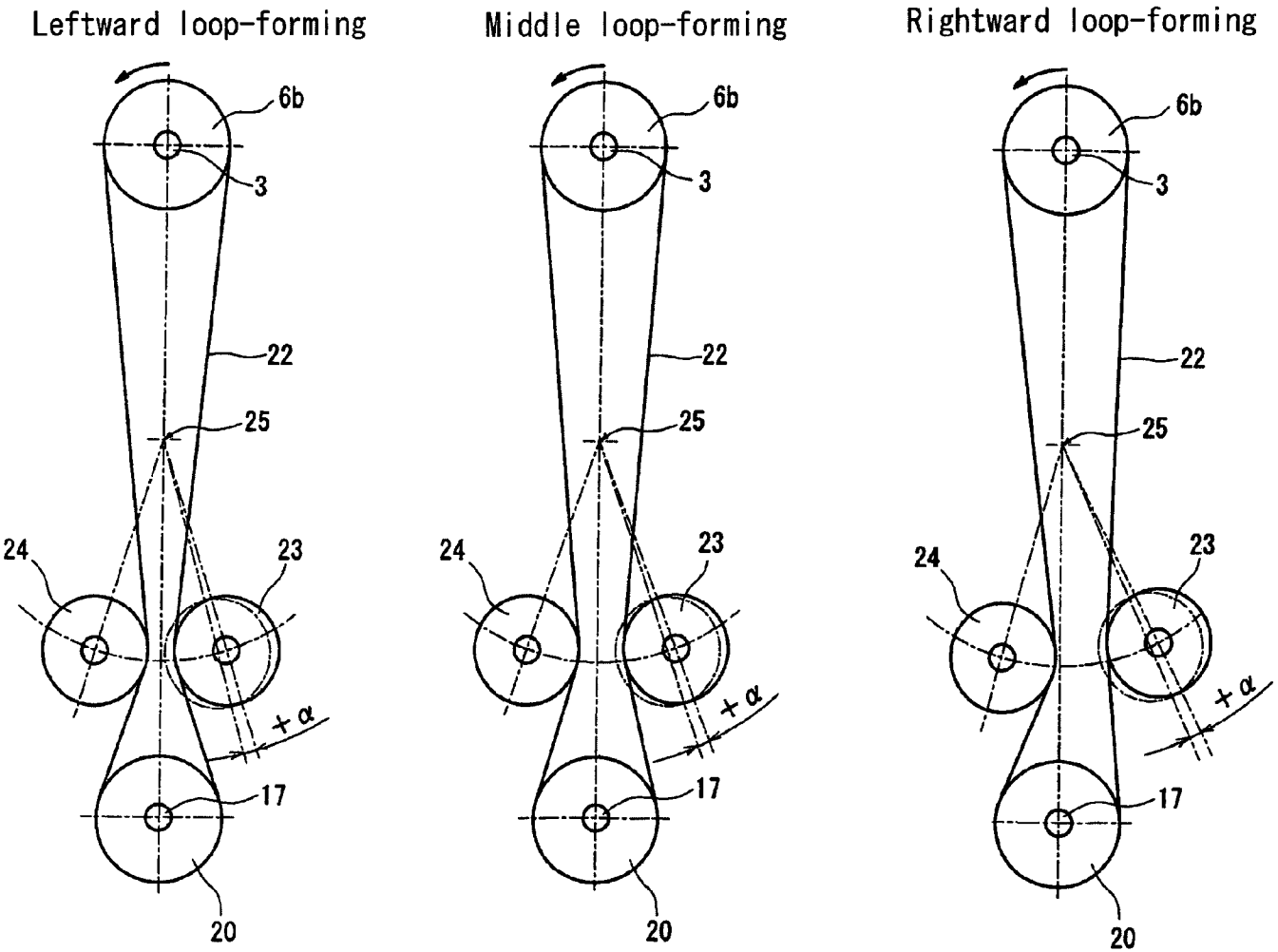
FIG. 11 is a view explaining movements of the timing belt and the pulleys when positions of a cam follower arm and a tension pulley bracket are adjusted by means of a fully threaded stud.

Based on that the tension pulley bracket 26 rotates about the shaft 25, in cases where a position of the tension pulley 23 has been adjusted by $+\alpha$ under the middle loop-forming condition, the tension pulley 23 also contacts the timing belt 22 in the position moved by $+\alpha$ in the leftward loop-forming condition and the rightward loop-forming condition as shown in FIG. 11. In the above-mentioned condition, the length of the timing belt 22 is uneven between a left side and a right side of its closed loop shape in the leftward loop-forming condition and in the rightward loop-forming condition. This is because the cam 42 is designed so that the tension pulley 23 and the tension pulley 24 are driven and moved to be symmetrically arranged with each other relative to an imaginary straight line connecting centers of the first timing pulley 6*b* mounted to the upper shaft 3 and the second timing pulley 20 mounted to the lower shaft 17 (i.e., a straight line) in the middle loop-forming condition, in other words, in a condition where no timing adjustment is made so as not to change the length of the timing belt 22.

Figure 12:
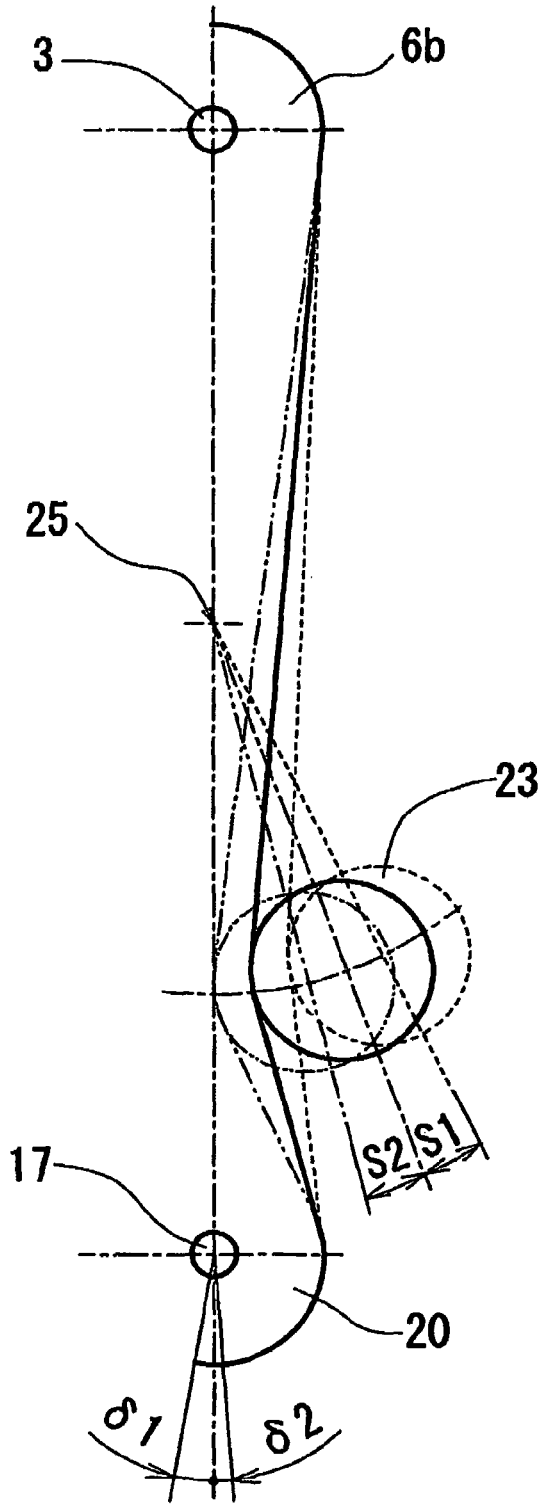
FIG. 12 is a view of a right side of the timing belt having a closed loop shape, illustrating changes in a length thereof.

In FIG. 12, $\delta 1$ (drawn with full lines) indicates an amount of an advanced angle of the second timing pulley 20 when the tension pulley 23 is moved by an angle S1 and $\delta 2$ indicates the amount of the advanced angle of the second timing pulley 20 when the tension pulley 23 is moved by an angle S2.

As is explained from FIG. 12, the angle S1 and the angle S2 are equal, however, the advanced angle $\delta 1$ and the advanced angle $\delta 2$ are not equal. This shows that even though the tension pulley 23 is moved by the same amount, the amount of the advanced angle of the second timing pulley 20, in other words, an amount of the changes in the length of the right side of its closed loop shape, varies depending on a position where the tension pulley 23 starts its movement. Therefore, when only the tension pulley 23 is adjusted by $+\alpha$ as described above, the looseness/tension applied by the tension pulley 23 to the timing belt 22 is changed, thereby causing a discrepancy between the looseness/tension applied by the tension pulley 23 and the looseness/tension applied by the tension pulley 24. Consequently, the tension of the timing belt 22 becomes inconstant.

Figure 13:
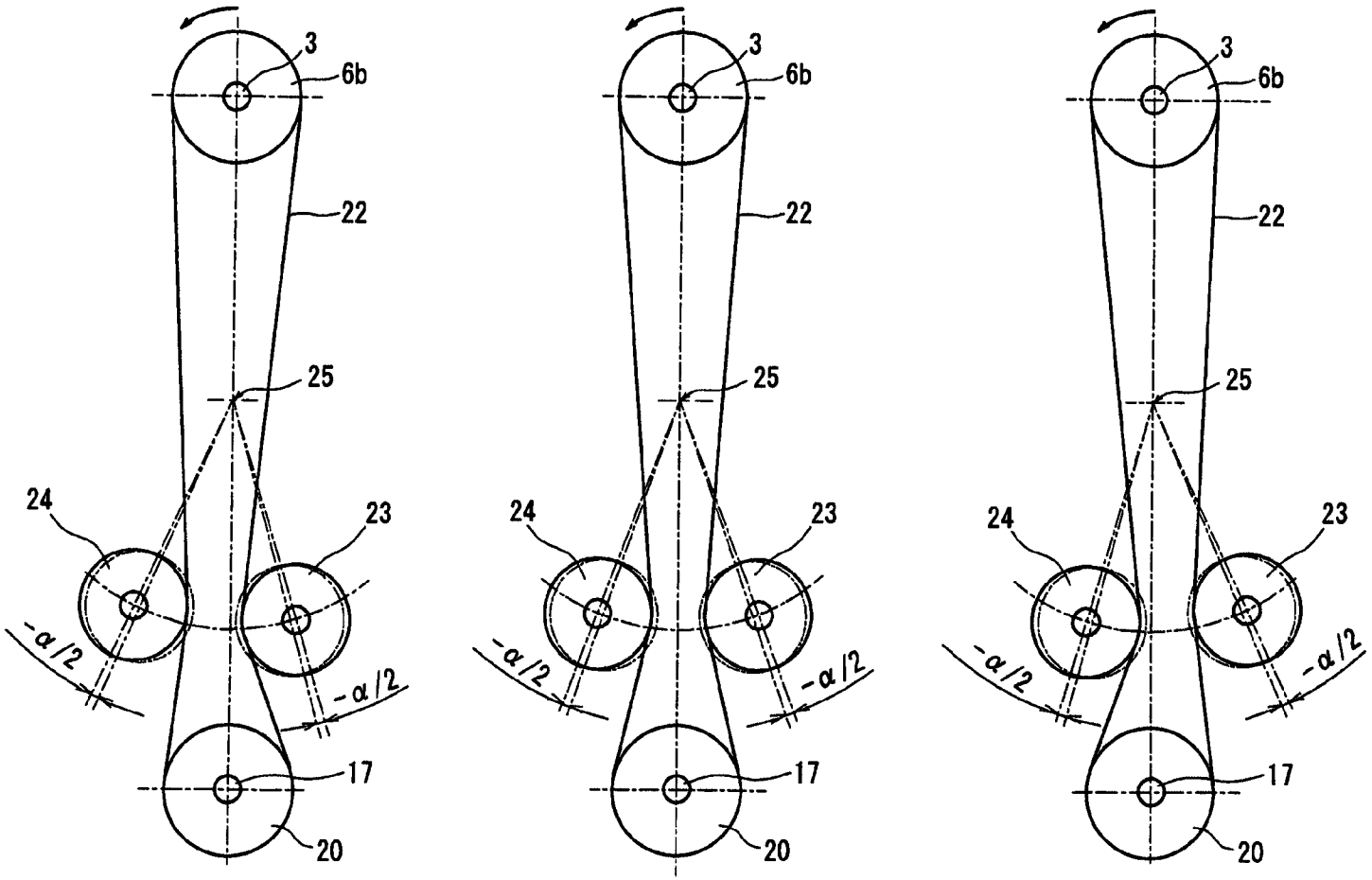
FIG. 13 is a view explaining movements of the timing belt and the tension pulleys when a mounting angle of the bracket is adjusted.

As shown in FIG. 13, in order to allow the tension pulley 23 and the tension pulley 24 to provide the equal belt tension/looseness to the timing belt 22, the tension pulley 23 and the tension pulley 23 need to be moved by a smaller degree when they are closer to the straight line and by a larger degree when they are away from the line. The screw holes 2*a* and 2*b* for mounting the bracket 39 to the machine frame 2 are each substantially oval shaped and positioned on the circumferences of concentric circles centered at the shaft 25, and thus the tension pulley bracket 39 is rotatable relative to the machine frame 2, and thus the tension pulley bracket 26, the tension pulley bracket 31, the cam follower arm 34, the cam 42 and the stepping motor 38, all of which are combined together with the bracket 39, are also rotatable relative to the machine frame 2.

When the tension pulley 23 is adjusted by $+\alpha$, and when the bracket 39 is rotated relative to the machine frame 2 by $-\alpha/2$, the tension pulley 23 and the tension pulley 24 are arranged symmetrically with each other relative to the straight line under the rightward loop-forming condition. Therefore, the length of the timing belt 22 becomes even between the left side and the right side of its closed loop shape in the leftward loop-forming condition and in the rightward loop-forming condition.

According to each of the embodiments of the present invention, since one of the tension pulley bracket 26 and the tension pulley bracket 31 follows the cam surface 42*a*, and the other one of the tension pulley bracket 26 and the tension pulley bracket 31 follows the cam surface 42*b*, an amount of each following movement relative to the rotational angle of the cam 42 is independently controlled. Therefore, the tension of the timing belt 22 related to the rotation speed of the looptaker 50 is kept constant by providing an appropriate outer contour (i.e., a cam profile) to each of the cam surfaces 42*a* and 42*b*. By keeping the tension of the timing belt 22 constant, the unexpected change in the rotation speed of the looptaker 50 is prevented. In addition, the timing of the needle 13 and the looptaker 50 is always set to be optimal to meet the needle's loop-forming position, thereby preventing the occurrence of the skipped stitches. Further, the torque acting on the upper shaft 3 and on the lower shaft 17 is kept constant, thereby assuring the stable operation of the sewing machine without noise or vibration.

According to each of the embodiments of the present invention, the cam 42 is driven by the stepping motor 38.

Consequently, the rotation speed of the looptaker 50 is freely controlled regardless of the rotation speed of the upper shaft 2 or the lower shaft 17.

According to each of the embodiments of the present invention, the tension pulley bracket 26 and the tension pulley bracket 31 are supported by the coaxial shaft 25 mounted to the machine frame 2.

Consequently, the number of the parts are reduced and a structure for supporting the tension pulley bracket 26 and the tension pulley bracket 31 is simplified compared to cases where the tension pulley bracket 26 and the tension pulley bracket 31 are separately supported.

According to the second embodiment of the present invention, the cam 42, the tension pulley bracket 26, and the tension pulley bracket 31 are assembled to the bracket 39 which makes a relative rotation about the shaft 25 relative to the machine frame 2 upon assembling for adjusting a position of the bracket 39 relative to the machine frame 2.

Consequently, when one of the tension pulley bracket 26 and the tension pulley bracket 31 is adjusted in the plus direction by, for example, $+\alpha$, relative to the shaft 25, the tension pulley 23 and the tension pulley 24 are assembled so as to be symmetrically arranged with each other relative to the straight line under the middle loop-forming condition by rotating the bracket 39 in the minus direction by, for example, $-\alpha/2$, relative to the shaft 25. And thus, in the leftward loop-forming condition and the rightward loop-forming condition, the length of the timing belt 22 is kept even between the left side and the right side of its loop shape. This solves issues such as decreased durability or noise generation, which are caused by repetitive application of tension/looseness to the timing belt 22 while the tension pulley 23 and the tension pulley 24 are being moved.

According to the second embodiment of the present invention, the relative rotation is achieved by means of an arc-shaped hole 2*a* and 2*b* provided on the machine frame 2 and a screw 40 and 40 inserted through the arc-shaped hole 2*a* and 2*b* to be threaded into the bracket 39.

According to each of the embodiments of the present invention, the cam 42 includes a plate, and the cam surface 42*a* and the cam surface 42*b* are provided on an outer peripheral surface of the plate.

According to each of the embodiments of the present invention, the cam surface 42*a* and the cam surface 42*b* are disposed adjacent to each other.

According to each of the embodiments of the present invention, the timing belt 22 is disposed between the tension pulley 23 and the tension pulley 24, and one of the tension pulley 23 and the tension pulley 24 decreases the tension applied to the timing belt 22 when the other one of the tension pulley 23 and the tension pulley 24 increases the tension applied thereto and increases the tension applied to the timing belt 22 when the other one of the tension pulley 23 and the tension pulley 24 decreases the tension applied thereto in response to a lateral shifting movement of the needle bar 12.

The principles, preferred embodiments and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An apparatus for adjusting a timing of a needle and a looptaker of a sewing machine provided at a zigzag sewing machine having an upper shaft for driving a needle bar holding a needle, a lower shaft for driving a looptaker, a machine frame for rotatably supporting the upper shaft and the lower shaft, a timing belt for connecting and synchronizing the upper shaft and the lower shaft, the apparatus for adjusting the timing of the needle and the looptaker of the sewing machine comprising;

a cam member including a first cam surface and a second cam surface and rotated by a driving force;

a first arm member and a second arm member each rotatably supported by the machine frame; and a first pulley and a second pulley mounted to the first arm member and the second arm member respectively and always contacting the timing belt, the first pulley following the first cam surface and the second pulley following the second cam surface.

2. The apparatus for adjusting the timing of the needle and the looptaker of the sewing machine as set forth in claim 1, wherein the cam member is driven by a stepping motor.

3. The apparatus for adjusting the timing of the needle and the looptaker of the sewing machine as set forth in claim 1, wherein the first arm member and the second arm member are supported by a coaxial shaft provided on the machine frame.

4. The apparatus for adjusting the timing of the needle and the looptaker of the sewing machine as set forth in claim 3, wherein the cam member, the first arm member and the second arm member are assembled to a bracket which makes a relative rotation about the shaft relative to the machine frame upon assembling for adjusting a position of the bracket relative to the machine frame.

5. The apparatus for adjusting the timing of the needle and the looptaker of the sewing machine as set forth in claim 4, wherein the relative rotation is achieved by means of an arc-shaped hole provided on the machine frame and a screw inserted through the arc-shaped hole to be threaded into the bracket.

6. The apparatus for adjusting the timing of the needle and the looptaker of the sewing machine as set forth in claim 3, wherein the cam member includes a plate, and the first cam surface and the second cam surface are provided on an outer peripheral surface of the plate.

7. The apparatus for adjusting the timing of the needle and the looptaker of the sewing machine as set forth in claim 6, wherein the first cam surface and the second cam surface are disposed adjacent to each other.

8. The apparatus for adjusting the timing of the needle and the looptaker of the sewing machine as set forth in claim 1, wherein the timing belt is disposed between the first pulley and the second pulley and wherein one of the first pulley and the second pulley decreases a tension applied to the timing belt when the other one of the first pulley and the second pulley increases the tension applied thereto, and increases the tension applied to the timing belt when the other one of the first pulley and the second pulley decreases the tension applied thereto in response to a lateral shifting movement of the needle bar.

9. A zigzag sewing machine, comprising:

an upper shaft for driving a needle bar holding a needle;

a lower shaft for driving a looptaker;

a machine frame for rotatably supporting the upper shaft and the lower shaft;

a timing belt for connecting and synchronizing the upper shaft and the lower shaft; and an apparatus for adjusting a timing of the needle and the looptaker of the sewing machine, the apparatus including;

a cam member including a first cam surface and a second cam surface and rotated by a driving force, a first arm member and a second arm member each rotatably supported by the machine frame; and a first pulley and a second pulley mounted to the first arm member and the second arm member respectively and always contacting the timing belt, the first pulley following the first cam surface and the second pulley following the second cam surface.

10. The zigzag sewing machine as set forth in claim 9, wherein the cam member is driven by a stepping motor.

11. The zigzag sewing machine as set forth in claim 9, wherein the first arm member and the second arm member are supported by a coaxial shaft provided on the machine frame.

12. The zigzag sewing machine as set forth in claim 11, wherein the cam member, the first arm member and the second arm member are assembled to a bracket which makes a relative rotation about the shaft relative to the machine frame upon assembling for adjusting a position of the bracket relative to the machine frame.

13. The zigzag sewing machine as set forth in claim 12, wherein the relative rotation is achieved by means of an arc-shaped hole provided on the machine frame and a screw inserted through the arc-shaped hole to be threaded into the bracket.

14. The zigzag sewing machine as set forth in claim 13, wherein the cam member includes a plate, and the first cam surface and the second cam surface are provided on an outer peripheral surface of the plate.

15. The zigzag sewing machine as set forth in claim 11, wherein the first cam surface and the second cam surface are disposed adjacent to each other.

16. The zigzag sewing machine as set forth in claim 9, wherein the timing belt is disposed between the first pulley and the second pulley and wherein one of the first pulley and the second pulley decreases a tension applied to the timing belt when the other one of the first pulley and the second pulley increases the tension applied thereto, and increases the tension applied to the timing belt when the other one of the first pulley and the second pulley decreases the tension applied thereto in response to a lateral shifting movement of the needle bar.

17. In a zigzag sewing machine wherein upper and lower shafts are connected by a timing belt for concurrent rotations, a looptaker is rotated about a fixed axis in response to the rotation of the lower shaft, a needle is moved vertically in response to the rotation of the upper shaft, and the needle is shifted laterally between first and second stitch positions with respect to the looptaker, the improvement for establishing the needle's equally optimal timed relationship with the looptaker at each of the first and second stitch positions comprising;

a cam member including a first cam surface and a second cam surface and rotated by a stepping motor;

a first arm member and a second arm member each rotatably supported by the machine frame; and a first pulley and a second pulley mounted to the first arm member and the second arm member respectively and always contacting the timing belt, the first pulley following the first cam surface and the second cam pulley following the second cam surface.

18. The improvement as set forth in claim 17, wherein the cam member, the first arm member and the second arm member are assembled to a bracket which makes a relative rotation about the shaft relative to the machine frame upon assembling for adjusting a position of the bracket relative to the machine frame.

19. The improvement as set forth in claim 17, wherein the cam member is in the form of a plate provided at its outer peripheral surface with the first cam surface and the second cam surface.

20. The improvement as set forth in claim 17, wherein the timing belt is disposed between the first pulley and the second pulley and wherein one of the first pulley and the second pulley decreases a tension applied to the timing belt when the other one of the first pulley and the second pulley increases the tension applied thereto, and increases the tension applied to the timing belt when the other one of the first pulley and the second pulley decreases the tension applied thereto in response to a lateral shifting movement of the needle bar.

* * * * *